United States Patent [19]

Ketchum, Jr.

[11] 4,416,615

[45] Nov. 22, 1983

[54] FUEL BURNER CONSTRUCTION

[76] Inventor: Elmer Ketchum, Jr., 21507 H. Dr., South, Homer, Mich. 49203

[21] Appl. No.: 234,832

[22] Filed: Feb. 17, 1981

[51] Int. Cl.[3] ..... F23Q 9/00

[52] U.S. Cl. ..... 431/285; 431/278; 431/281

[58] Field of Search ..... 431/278, 285, 281; 110/262, 264

[56] References Cited

U.S. PATENT DOCUMENTS

| | | | |
|---|---|---|---|
| 2,702,743 | 2/1955 | Totzek | 110/264 |
| 2,719,584 | 10/1955 | Winslow | 431/285 |
| 2,734,560 | 2/1956 | Harris et al. | 431/285 |
| 2,873,798 | 2/1959 | Knight | 431/285 |
| 3,088,681 | 5/1963 | McCutcheon, Jr. | 431/285 |
| 3,198,239 | 8/1965 | Webster | 431/278 |
| 3,802,827 | 4/1974 | Semenov et al. | 431/285 |
| 3,985,494 | 10/1976 | Childree | 431/285 |
| 4,032,287 | 6/1977 | Blum et al. | 431/278 |
| 4,035,137 | 7/1977 | Arand | 431/285 |
| 4,194,874 | 3/1980 | Voorheis et al. | 431/278 |
| 4,298,338 | 11/1981 | Babington | 431/285 |

*Primary Examiner*—Henry C. Yuen

*Attorney, Agent, or Firm*—Learman & McCulloch

[57] ABSTRACT

A fuel burner comprises a body having walls defining a chamber open at one end and accommodated in a conduit through which air may be delivered to the burner. Two opposed walls of the chamber are apertured to accommodate nozzles through which atomized fuel may be discharged in streams which impinge upon each other between the ends of the chamber. At the closed end of the chamber are gaps through which air may enter the chamber and pass out the open end of the latter. Adjacent the open end of the chamber are additional nozzles through which atomized fuel may be discharged. Air for atomization of the fuel is delivered from the air conduit and passes through passages in the nozzles. Each nozzle has a transverse passageway to which fuel is supplied, which fuel is entrained in air passing through the nozzle passages. A spark generating device is positioned within the chamber to ignite atomized fuel.

21 Claims, 6 Drawing Figures

FUEL BURNER CONSTRUCTION

BACKGROUND OF THE INVENTION

In boilers of the kind utilized in electric power generating installations it is common to utilize a large number of main burners for the combustion of liquid, gaseous, or solid fuel at a rate sufficient to generate steam for the driving of turbine generators. Before igniting the main burners, however, it is common practice to combust fuel at a lesser rate utilizing so-called warm-up burners or lighters. The warm-up burners are utilized to raise the temperature and pressure of a boiler at a desired rate, following which the main burners may be ignited from flames produced by the warm-up burners.

Fuel discharged from the warm-up burners conventionally is ignited from so-called igniters located within or adjacent the warm-up burners and through which fuel is discharged and ignited to form a flame which can be utilized to ignite the warm-up burners.

One of the disadvantages of conventional boiler systems of the kind referred to above is the necessity of having to provide three separate sets of burners, i.e., the igniter burners, the warm-up burners, and the main burners. Among the advantages of the present invention is its ability to function both as an igniter and as a warm-up burner.

SUMMARY OF THE INVENTION

A fuel burner constructed in accordance with the invention comprises a walled body forming a chamber open at one end and located within a duct or conduit through which combustion-supporting air may be delivered through the chamber and into a boiler. On opposite sides of the chamber and between the ends of the latter are opposed fuel nozzles which confront one another so that fuel streams which are discharged from the nozzles impinge on one another. Fuel thus introduced in the chamber is ignited within the latter.

The chamber has a closure at that end opposite its open end, but the closure is not a sealed closure. Instead, the closure includes gaps through which air may enter the chamber from the conduit. Such air provides additional combustion air, maintains the walls of the chamber relatively cool, and sweeps the flame through the open end of the chamber into the boiler.

Adjacent the open end of the chamber is a plurality of additional fuel nozzles through which fuel may be discharged inwardly of the boiler. As fuel is discharged from the additional nozzles, such fuel is ignited by the igniter flame. The additional nozzles, therefore, may be used as the warm-up burner and the flame supported by the additional nozzles may be directed along paths which will ensure the ignition of fuel discharged from the main burners.

The combined igniter and warm-up burner is wholly contained within the air conduit which, if desired, may be separated from the boiler by movement outwardly of the latter.

A preferred fuel nozzle has an axial air passage extending completely through the nozzle and in communication with the air conduit. Each nozzle also preferably has a transverse passageway which communicates with the air passage on opposite sides of the latter and to which fuel may be supplied. The fuel and air thus are mixed in the air passage so that fuel discharged from each nozzle is atomized.

DESCRIPTION OF THE DRAWINGS

A preferred embodiment of a burner unit constructed in accordance with the invention is illustrated in the accompanying drawings, wherein.

DETAILED DESCRIPTION

Figure 1:
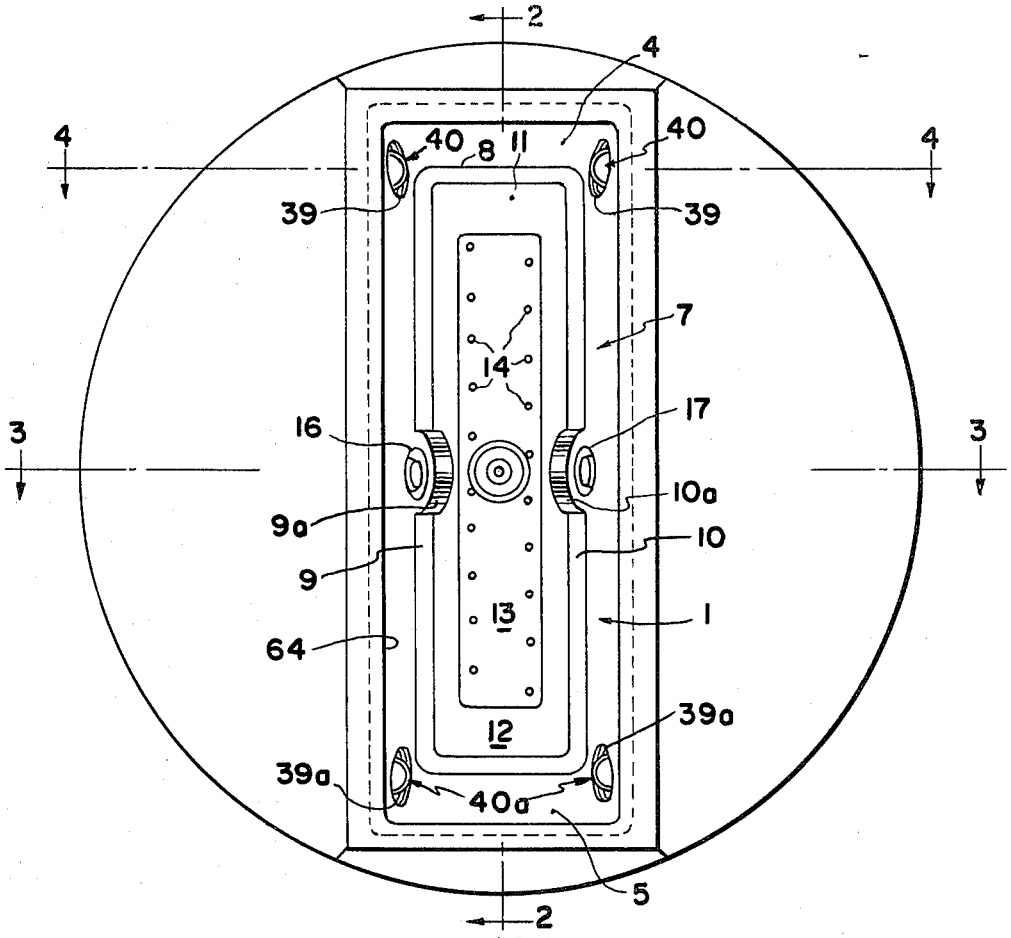
FIG. 1 is a front elevational view of the burner and air conduit.

A burner construction according to the invention comprises a body 1 having opposed, spaced side walls 2 and 3, opposed, spaced top and bottom walls 4 and 5, respectively, and a closure 6 at one end together forming a chamber 7 open at its other end. The walls 2–5 diverge in a direction toward the open end of the chamber.

The closure 6 comprises a sleeve-like member 8 having side walls 9 and 10 and top and bottom walls 11 and 12 which parallel the corresponding walls 2–5. Welded or otherwise fixed to the sleeve 8 in an end wall or plug 13 having a plurality of vertically spaced, forwardly converging openings 14 which communicate with the interior of the sleeve 8. The openings 14 adjacent opposite sides of the plug 13 are staggered, as is best shown in FIG. 1.

The sleeve 8 is concentrically mounted within the chamber 7 with the walls 9–12 spaced from the corresponding chamber walls 2–5 to provide between the sleeve 8 and the chamber walls a gap 15 that encircles the sleeve.

The body 1 and the closure 6 may be maintained in fixed relation relative to each other and to the chamber by tack welding or in any other manner so as to ensure that the great majority of the gap 15 is unobstructed. The relative positions of the sleeve 8 and the body 1 are such as to provide cross-sectional areas for the gap 15 sufficient to provide ample combustion air to the chamber 7 and for other purposes to be explained.

The side walls 2 and 3 of the chamber 7 are provided with apertures 16 and 17, respectively, which confront one another and are located between the ends of the chamber. The walls 9 and 10 of the sleeve 8 are provided with notches **9*a* and 10*a***, respectively, adjacent the apertures.

Figure 3:
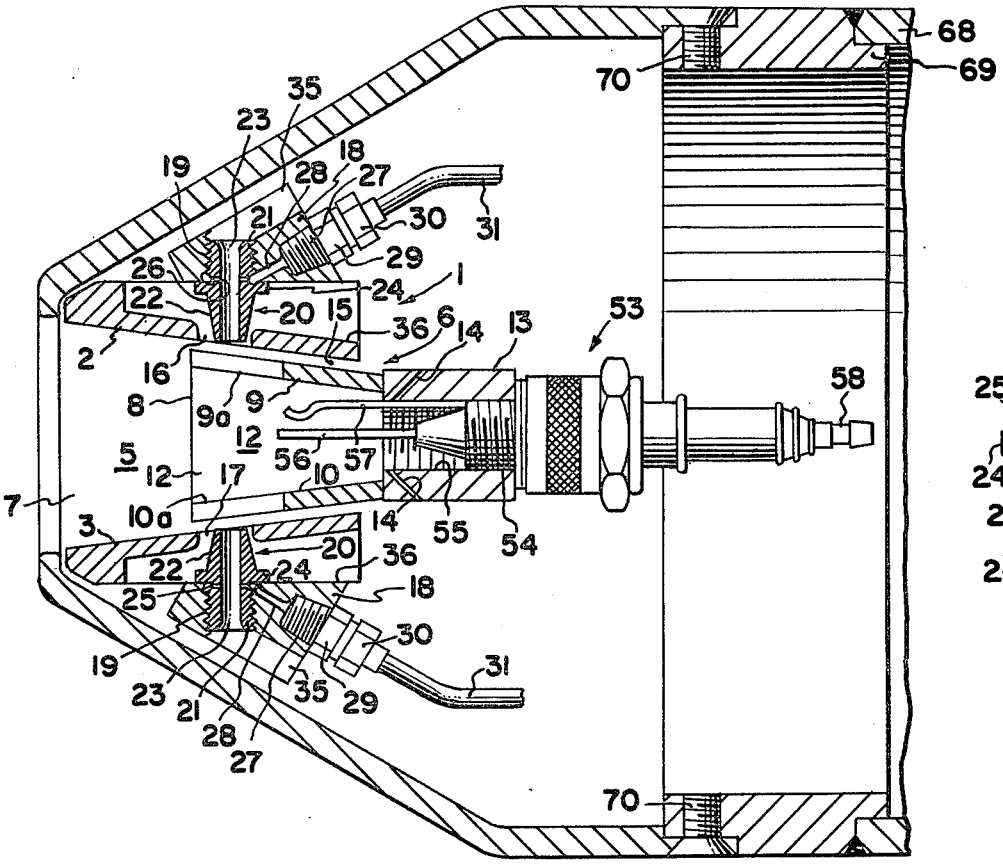
FIG. 3 is an enlarged, transverse sectional view taken on the line 3—3 of FIG. 1.
Figure 5:
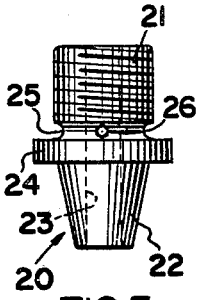
FIG. 5 is an enlarged, elevational view of an igniter fuel nozzle.

Each of the side walls 2 and 3 of the body is provided with an external extension 18 through which extends a threaded opening 19 (see FIG. 3). Accommodated in each opening 19 is a fuel nozzle 20 having a threaded shank 21 and a tapering tip 22. Each nozzle 20 has an axial gas passage 23 extending therethrough. At the juncture of the shank 21 and the tip 22 is an annular flange 24, and between the flange 24 and the threads of the shank 21 is an external, annular groove 25. Extending inwardly from the groove 25 is a transverse fuel passageway 26 passing completely through the shank of the nozzle and communicating with the passage 23 on diametrically opposed sides of the latter. Each flange 24 is provided with a gasket or seal (not shown) that seats on the associated extension 18.

Each extension 18 has a threaded socket 27 which communicates with a passage 28 which, in turn, communicates with the groove 25 of the associated nozzle 20. Accommodated in each of the sockets 27 is a correspondingly threaded fitting 29, each of which is joined by a coupling 30 to one end of a fuel line 31 the opposite end of which is coupled to a tee 32 forming part of a disconnect coupling 33 fitted to a line 34 by means of which liquid or gaseous fuel may be delivered to the associated nozzle from a reservoir under the control of a pump (not shown).

Each extension 18 has an outboard groove 35 in communication with the outboard end of the gas passage 23 in the associated nozzle 20 and each extension also has another groove 36 which communicates with the associated apertures 16 and 17 in the chamber walls. Air thus may be supplied to each of the apertures 16 and 17 and to each of the nozzle passages 23. As is best indicated in FIG. 3, the cross-sectional areas of the apertures 16 and 17 are greater than the corresponding areas of the tips of the nozzles, thereby enabling air to enter the chamber 7 via the grooves 36 and the apertures.

Figure 4:
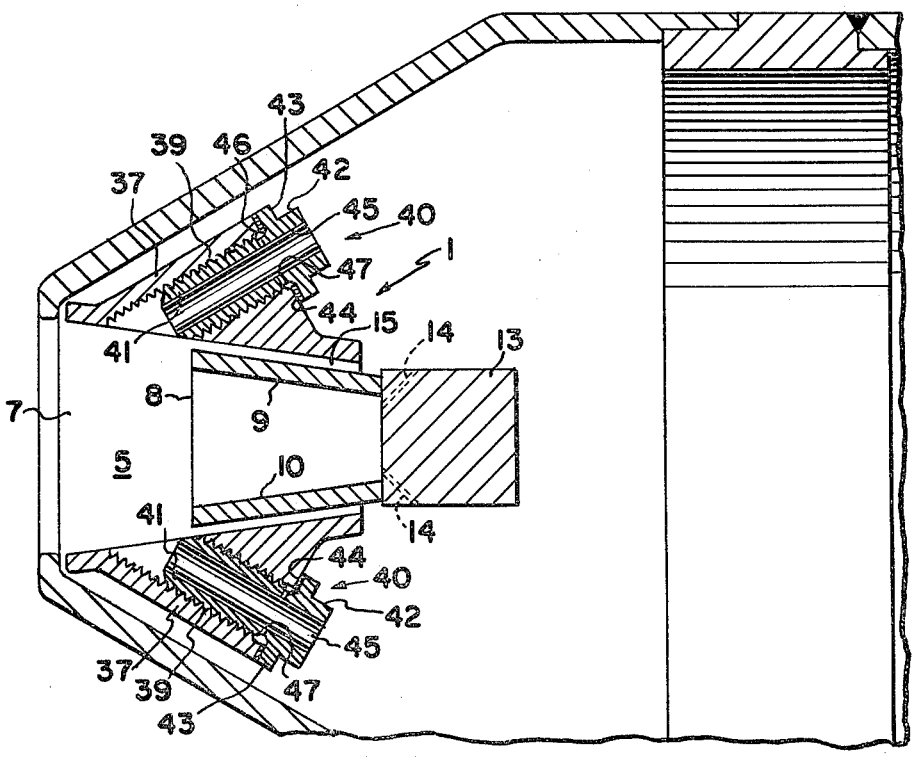
FIG. 4 is an enlarged sectional view taken on the line 4—4 of FIG. 1.
Figure 6:
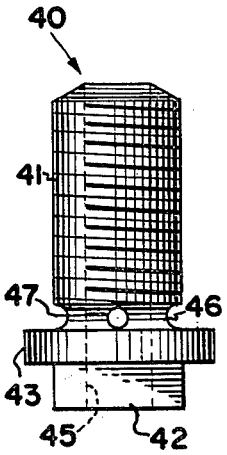
FIG. 6 is an enlarged, elevational view of a warm-up burner fuel nozzle.

Each of the chamber side walls 2 and 3 is provided with an upper and lower, external extension 37 and 38, respectively, adjacent the open end of the chamber. See FIG. 2. Each of the upper extensions 37 has a threaded bore 39 (FIG. 4) communicating with the chamber 7 adjacent the open end thereof and in which is accommodated a fuel nozzle 40 having a threaded stem 41 and a square head 42. Each nozzle 40 also has a flange 43 which seats on a gasket 44. Each nozzle 40 has an axial gas passage 45 extending completely therethrough, and between the stem 41 and the flange 43 is an annular groove 46. A transverse passageway 47 extends through the stem 41 of the nozzle and establishes communication between the passage 45 and the groove 46.

Each of the upper extensions 37 has a socket (not shown) like the socket 27 and which communicates with the groove 46. One end of a fuel line 48 is fitted to such bore by a coupling 49, the opposite end of the fuel line being connected to a fitting 50 forming part of a disconnect coupling 51 to which is coupled a fuel line 52 for delivering fuel via a pump (not shown) to the groove 46 whence it is discharged into the passage 45 through the passageway 47. Air may enter each nozzle 40 via the passage 45 and mix with fuel discharged through the passageway 47 so as to deliver atomized fuel into the chamber 7 adjacent its open end.

Each of the lower extensions 38 has a nozzle **40*a* like the nozzles 40, and corresponding parts are identified by corresponding reference characters, followed by the suffix a. Each lower extension 38 also has a similar fuel line 48*a* coupled to the fitting 50**.

Figure 2:
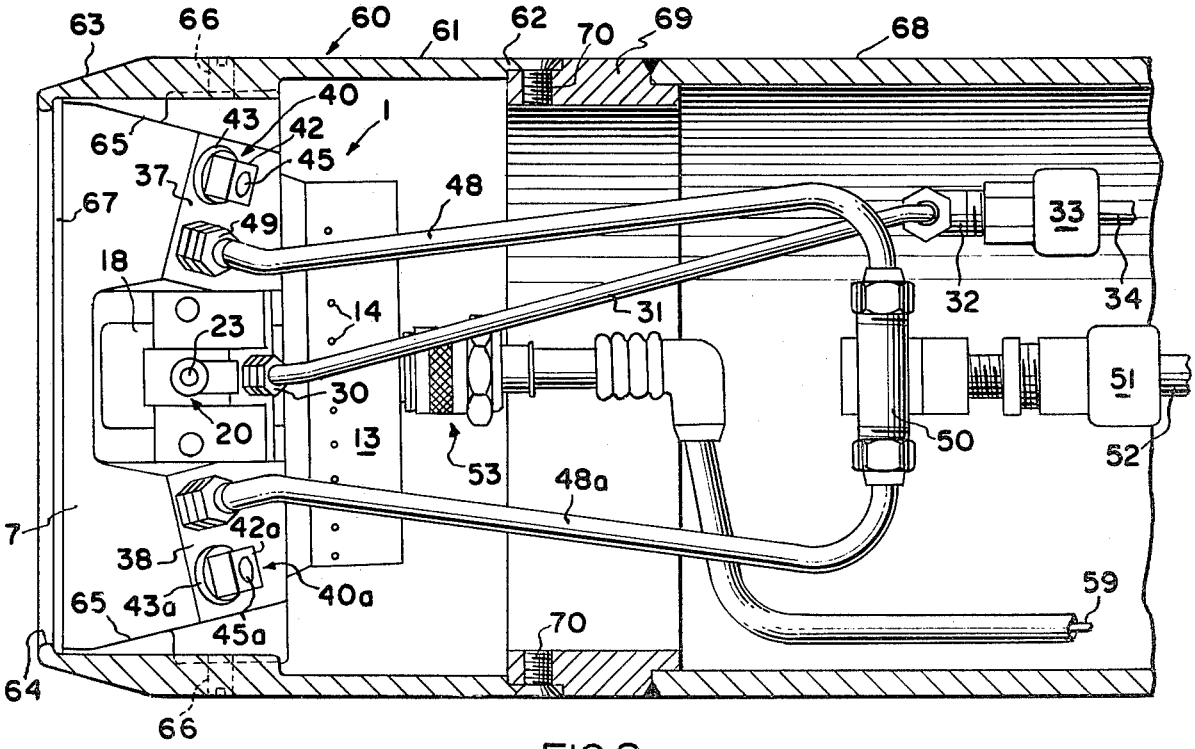
FIG. 2 is an enlarged, longitudinal sectional view taken on the line 2—2 of FIG. 1.

As is best indicated in FIG. 2, the upper nozzles 40 and the lower nozzles **40*a* are inclined to a horizontal plane passing between them so that the atomized fuel discharged from such nozzles diverges in a direction outwardly of the chamber 7. The upper and lower nozzles 40, 40*a* respectively (FIG. 1**), also are inclined to a vertical plane passing between them so that the atomized fuel streams converge in a direction outwardly of the chamber.

Means is provided within the chamber 7 for initiating the ignition of fuel within the chamber. The ignition means may comprise a spark plug 53 having a body 54 fitted into a socket 55 formed in the closure plug 13. The spark plug includes a pair of electrodes 56 and 57 between which a spark may be established via a conductor 58 that may be coupled by suitable wiring 59 to a source of electrical energy.

The body 1 and its associated parts are fitted into an air duct or conduit 60 comprising a hollow housing 61 having a mounting flange 62 at one end and a tapered nose 63 at its other end defining a rectangular opening 64 of slightly smaller area than that of the open end of the chamber 7. The housing 61 has tapered ribs 65 on which the body 1 rests, and set screws 66 react between the housing 61 and the body 1 to fix the latter within the housing in a position to provide a gap 67 between the nose 63 and the open end of the body through which air may pass for a purpose to be described.

The housing 61 is fitted to one end of a cylindrical pipe 68 by means of a coupling 69 and screws 70, the opposite end of the pipe being coupled to a source of pressurized combustion-supporting gas, such as air.

To condition the apparatus for operation, the nose 63 of the housing 60 will be fitted into an opening formed in the wall of a boiler housing and located between adjacent main burners. In the operation of the apparatus, air is caused to flow through the pipe 68 into the housing 60. The air is maintained at a pressure within the housing adequate to ensure that fuel in the nozzles will be atomized and entrained at sufficient velocity to cause the fuel streams from the igniter nozzles 20 to impinge on one another. A pressure of between about 0.3 and 3 p.s.i. has been adequate for this purpose, but it will be understood that the pressure will vary in relation to the size of the nozzles and other gas passages.

Air from the housing 60 enters the chamber 7 via the apertures 16 and 17, the gas passages 23 in the nozzles 20, the openings 14, the gap 15, and the gas passages 45, **45*a* in the nozzles 40, 40*a*. Fuel under pressure is delivered via the lines 31 to the igniter nozzles 20. Fuel is discharged from the lines 31 into the grooves 25 and from the grooves 25 into the passages 23 via the passageways 26. Fuel entering the passages 23 is entrained by the air flowing therethrough, atomized, and discharged into the chamber 7**.

The atomized fuel streams discharged from the igniter nozzles 20 impinge upon one another and form a spray which extends circumferentially of the longitudinal axes of the igniter nozzles. Fuel is thoroughly mixed with air entering the chamber via the openings 14 and is ignited by the spark plug 53. The flame created by the burning fuel is swept toward the open end of the chamber 7 by air which enters the chamber via the openings 14 and the gap 15. Air passing through the gap 15 traverses the sides of the sleeve 8 and of the chamber, thereby preventing the accumulation of fuel residues on such walls. In addition, the flow of air across the walls of the sleeve and the chamber maintains such walls cool, thereby avoiding warpage and other adverse effects of fuel combustion.

Following establishment of the flame by the combustion of the fuel discharged from the igniter nozzles 20, fuel may be admitted to the additional nozzles 40, **40*a* where it will be entrained and atomized by air passing through the passages 45, 45*a* and discharged into the chamber 7 adjacent the open end of the latter and into the path of flame generated by the combustion of fuel discharged from the igniter nozzle 20. Fuel discharged from the nozzles 40, 40*a***, thus will be ignited to create a flame which is projected into the interior of the boiler and laterally toward the adjacent main burners.

The fuel capacity of the additional nozzles 40, 40*a* is greater than that of the igniter nozzles. As a consequence, the heat generated by the combustion of fuel discharged from the additional burners is greater. Such heat gradually will raise the temperature and pressure within the boiler to a level at which the main burners may be ignited.

Air constantly will pass through the gap 67 at the nose of the housing 60 and prevent fuel, should there be any leakage, from accumulating at the lower side of the body 1.

The disclosure is representative of a presently preferred form of the invention, but is intended to be illustrative rather than definitive thereof. The invention is defined in the claims.

I claim:

1. A fuel burner construction comprising a walled body having a chamber open at one end and including a pair of confronting walls having opposed apertures therein; a nozzle accommodated in each of said apertures, each of said nozzles having a gas passage therein extending axially therethrough, each of said nozzles having a fuel passageway extending inwardly and transversely of said nozzle and communicating with said gas passage between the ends of the latter for delivering fuel into said gas passage; means for supplying fuel to each of said fuel passageways; and means for delivering atomizing gas to and through each of said gas passages, whereby an atomized mixture of gas and fuel may be discharged from each gas passage into said chamber.

2. The construction according to claim 1 wherein each of the said apertures has a cross-sectional area greater than that of the associated nozzle.

3. The construction according to claim 2 wherein a gap exists between each of said nozzles and the edge of the associated aperture.

4. The construction according to claim 1 wherein said body has a closure member opposite and spaced from said open end, said closure member being encircled by a gap in communication with said chamber.

5. The construction according to claim 4 wherein said closure member has a number of openings therein communicating with said chamber.

6. The construction according to claim 5 wherein said openings converge in a direction toward said chamber.

7. The construction according to claim 1 including a sleeve accommodated within said body, said sleeve and said body being so dimensioned as to form a gap therebetween.

8. The construction according to claim 5 wherein said gap encircles said sleeve.

9. The construction according to claim 1 including a plurality of openings in said confronting walls of said body, an additional nozzle accommodated in each of said openings, and means for delivering fuel to each of said additional nozzles.

10. The construction according to claim 9 wherein each of said additional nozzles has a gas passage therein, a fuel passageway extending transversely of and communicating with said gas passage, and means for delivering atomizing gas to said gas passage.

11. The construction according to claim 1 including fuel igniting means in said chamber.

12. The construction according to claim 1 wherein said body has a closure member opposite and spaced from said open end, said closure member having a number of openings therein communicating with said chamber.

13. A fuel burner construction comprising a body having top, bottom, and side walls and a closure at its rear end together forming a chamber open at its forward end; a pair of fuel nozzles communicating with said chamber through the side walls thereof and between its rear and forward ends, said nozzles confronting and directly opposing one another; a plurality of additional fuel nozzles communicating with said chamber between its forward end and said pair of fuel nozzles; means for supplying fuel to each of said nozzles; and means for supplying atomizing gas to each of said nozzles, each nozzle of said pair of fuel nozzles having fuel and atomizing gas passages communicating with each other inwardly of such nozzle whereby each nozzle of said pair of fuel nozzles may discharge an atomized mixture of fuel and gas into said chamber.

14. The construction according to claim 12 wherein the additional nozzles are arranged so that fuel discharged therefrom diverges from a horizontal plane lying therebetween.

15. The construction according to claim 12 wherein the additional nozzles are arranged so that fuel discharged therefrom converges toward a vertical plane lying therebetween.

16. The construction according to claim 12 wherein a gap exists between said closure and the walls of said body.

17. The construction according to claim 16 including means for supplying a gas to said gap.

18. The construction according to claim 12 wherein the nozzles of said pair of nozzles are arranged so that atomized fuel discharged from each of said nozzles impinges on atomized fuel discharged from the other of said nozzles.

19. The construction according to claim 12 including fuel igniting means mounted in said chamber between its forward and rear ends.

20. The construction according to claim 12 wherein the fuel capacity of each of said additional nozzles is greater than that of either nozzle of said pair of nozzles.

21. A fuel burner construction comprising a pair of nozzles; means mounting said nozzles in opposed, spaced apart, directly confronting relation; an air passage extending axially completely through each of said nozzles; means for delivering fuel transversely into each air passage between its ends; and means for delivering air through the air passage of each of said nozzles at a velocity sufficient to atomize, entrain, and discharge such fuel from each of said nozzles, said nozzles being so located by said mounting means that atomized fuel discharged from each of said nozzles impinges on atomized fuel discharged from the other of said nozzles.

* * * * *